United States Patent [19]

Murphy

[11] 4,379,080

[45] Apr. 5, 1983

[54] GRANULAR DETERGENT COMPOSITIONS CONTAINING FILM-FORMING POLYMERS

[75] Inventor: Alan P. Murphy, Colerain Township, Belmont County, Ohio

[73] Assignee: The Procter & Gamble Company, Cincinnati, Ohio

[21] Appl. No.: 256,454

[22] Filed: Apr. 22, 1981

[51] Int. Cl.[3] ..... C11D 3/08; C11D 3/12; C11D 3/37; C11D 17/06

[52] U.S. Cl. ..... 252/526; 252/135; 252/140; 252/155; 252/174; 252/174.17; 252/174.24; 252/174.25; 252/179; 252/527; 252/528; 252/531; 252/532; 252/535; 252/536; 252/539

[58] Field of Search ..... 252/135, 140, 174, 174.17, 252/174.24, 174.25, 179, 131, 526, 528, 531, 532, 535, 536, 539, 527

[56] References Cited

U.S. PATENT DOCUMENTS

| | | | |
|---|---|---|---|
| 3,380,922 | 4/1968 | Shields . | |
| 3,629,121 | 12/1971 | Eldib . | |
| 3,794,605 | 2/1974 | Diehl . | |
| 3,803,285 | 4/1974 | Jensen . | |
| 3,920,570 | 11/1975 | Mulders . | |
| 3,933,673 | 1/1976 | Davies . | |
| 3,985,669 | 10/1976 | Krummel et al. . | |
| 4,072,621 | 2/1978 | Rose . | |
| 4,180,485 | 12/1979 | Llenado . | |
| 4,303,557 | 12/1981 | Rose | 252/527 |
| 4,325,829 | 4/1982 | Duggleby | 252/109 |

FOREIGN PATENT DOCUMENTS

| | | |
|---|---|---|
| 2615698 | 10/1977 | Fed. Rep. of Germany . |
| 2854484 | 6/1980 | Fed. Rep. of Germany . |
| 1333915 | 10/1973 | United Kingdom . |
| 1380402 | 1/1975 | United Kingdom . |
| 2048841 | 12/1980 | United Kingdom . |

OTHER PUBLICATIONS

U.S. Pat. Ser. No. 256,453, pending.

*Primary Examiner*—Dennis L. Albrecht
*Attorney, Agent, or Firm*—Donald E. Hasse; Robert B. Aylor; Richard C. Witte

[57] ABSTRACT

Granular detergent compositions containing an organic surfactant, an aluminosilicate ion exchange material, a water-soluble neutral or alkaline salt and a film-forming polymer soluble in an aqueous slurry of the above components are disclosed. The compositions contain no or low levels of phosphate and silicate materials, yet provide granules which exhibit superior free-flowing characteristics and solubility in the laundering solution.

31 Claims, No Drawings

GRANULAR DETERGENT COMPOSITIONS CONTAINING FILM-FORMING POLYMERS

TECHNICAL FIELD

The present invention relates to granular detergent compositions containing a detergent surfactant, an aluminosilicate ion exchange material, a water-soluble neutral or alkaline salt and a film-forming polymer. The compositions herein, which contain no or only low levels of phosphate materials and less than about 3% by weight of alkali metal silicate materials, provide granules having both superior free-flowing characteristics and solubility in the laundering solution.

Granular detergent compositions have, in the past, often contained high concentrations of phosphate builder materials, particularly sodium tripolyphosphate. When a crutcher mix containing sodium tripolyphosphate is spray-dried, it is believed that enough mixed-phosphate hydrolysis products are formed to inhibit phosphate crystal growth. The hydrolysis products are concentrated in the liquid phase which finally dries to an amorphous glassy phosphate material. This glassy material effectively "cements" the finely crystalline granule walls together, producing granules which exhibit very desirable physical properties, i.e., crisp, durable and free-flowing granules. Moreover, the glassy phosphate material readily disintegrates in the laundering solution so that no insoluble residue is left on the fabrics.

Alkali metal silicates are usually included in granular detergents at low levels for corrosion inhibition and processing reasons. When phosphate builders are removed from detergents, the level of silicate is often increased severalfold since it also dries to a tough glassy film capable of strengthening granule walls and enhancing free-flowing characteristics. Silicates having a lower $SiO_2$ to alkali metal oxide ratio (e.g., 1.6–2.0) are usually selected because they are more water-soluble than the higher ratio silicates. However, exposure of the silicate to carbon dioxide during drying and storage can shift its ratio to a higher value and reduce its solubility, resulting in detergent granules which do not completely disintegrate in the laundering solution, and an unacceptably high level of insoluble material being deposited on fabrics. The insolubles problem can be particularly severe when the detergent composition also contains the water-insoluble aluminosilicate material herein since higher levels of silicates (e.g., above about 3%) enhance the deposition of the aluminosilicates onto fabrics.

BACKGROUND ART

U.S. Pat. No. 3,985,669, Krummel, et al., issued Oct. 12, 1976, describes the use of low levels (i.e., about 0.5% to 3%) of alkali metal silicates in granular detergent compositions also containing aluminosilicate builder materials to provide both corrosion inhibition and crispness benefits without enhancing deposition of the aluminosilicates onto fabrics.

U.S. Pat. No. 4,072,621, Rose, issued Feb. 7, 1978, discloses the addition of a water-soluble copolymer of a vinyl compound and maleic anhydride to granular detergents containing aluminosilicate builders. The compositions provide improved granule physical properties, particularly relating to reduced dustiness, and improved cleaning performance in the presence of appreciable amounts of orthophosphate and pyrophosphate, such as formed by the hydrolysis of polyphosphates during spray-drying operations. The compositions disclosed in the examples contain 20% by weight of phosphate materials.

British Pat. No. 2,048,841, published Dec. 17, 1980, discloses the use of polymeric acrylamides to stabilize aqueous suspensions of zeolites. The suspensions are said to be suitable for spray-drying to obtain detergent compositions.

German Pat. No. 2,615,698, published Oct. 20, 1977, describes stable suspensions containing aluminosilicates, dispersing agents which can include polymers containing carboxylic and/or hydroxyl groups, and stabilization agents. The suspensions are said to be useful in the manufacture of spray-dried detergents.

German Pat. No. 2,854,484, published June 26, 1980, discloses stable zeolite suspensions containing polyacrylamides or copolymers thereof with acrylic acid. The suspensions are said to be useful as sequestering agents in spray-dried detergent compositions.

SUMMARY OF THE INVENTION

The present invention encompasses granular detergent compositions comprising:

(a) from about 5% to about 40% by weight of an organic surfactant selected from the group consisting of anionic, nonionic, zwitterionic, ampholytic and cationic surfactants, and mixtures thereof;

(b) from about 10% to about 60% of a finely divided aluminosilicate ion exchange material selected from the group consisting of:

(1) crystalline aluminosilicate material of the formula:

$$Na_z[(AlO_2)_z.(SiO_2)_y].xH_2O$$

wherein z and y are at least 6, the molar ratio of z to y is from 1.0 to 0.5 and x is from 10 to b 264, said material having a particle size diameter of from about 0.1 micron to about 10 microns, a calcium ion exchange capacity of at least about 200 mg. $CaCO_3$ eq./g. and a calcium ion exchange rate of at least about 2 grains $Ca^{++}$/gallon/minute/gram/gallon;

(2) amorphous hydrated aluminosilicate material of the empirical formula:

$$M_z(zAlO_2.ySiO_2)$$

wherein M is sodium, potassium, ammonium, or substituted ammonium, z is from about 0.5 to about 2 and y is 1, said material having a magnesium ion exchange capacity of at least about 50 milligram equivalents of $CaCO_3$ hardness per gram of anhydrous aluminosilicate and a $Mg^{++}$ exchange rate of at least about 1 grain/gallon/minute/gram/gallon; and (3) mixtures thereof;

(c) from about 5% to about 75% by weight of a water-soluble neutral or alkaline salt; and (d) from about 0.1% to about 10% by weight of a film-forming polymer soluble in an aqueous slurry comprising the above components; said composition containing less than about 10% by weight of phosphate materials and less than about 3% by weight of alkali metal silicate materials.

DETAILED DESCRIPTION OF THE INVENTION

The granular detergent compositions of the present invention contain, as essential components, a detergent surfactant, an aluminosilicate ion exchange material, a water-soluble neutral or alkaline salt and a film-forming polymer, as described hereinafter. The compositions contain less than about 3%, preferably less than about 2%, by weight of alkali metal silicate materials and less than about 10%, preferably less than about 5%, by weight of phosphate materials. Most preferably, the compositions are substantially free of phosphate materials.

The compositions herein are prepared by drying an aqueous slurry comprising the above components. The slurry generally contains from about 25% to about 50% water, whereas the dried granules contain from about 3% to about 15% water. The drying operation can be accomplished by any convenient means, for example, by using spray-drying towers, both counter-current and co-current, fluid beds, flash-drying equipment, or industrial microwave or oven drying equipment. While not intending to be limited by theory, it is believed that the granular detergents herein exhibit superior free-flowing characteristics because the film-forming polymer dries to a tough, non-sticky, non-hygroscopic film which cements the granule walls together much in the same manner as do the glassy phosphates and silicates. Since the polymer film is readily water-soluble, the granules quickly disintegrate in the laundering solution and leave little or no insoluble residue on the fabrics. Moreover, the film-forming polymer does not enhance the deposition of the aluminosilicate material onto fabrics, as do higher levels of the alkali metal silicates.

ORGANIC SURFACTANT

The detergent compositions herein contain from about 5% to about 40% by weight of an organic surfactant selected from the group consisting of anionic, nonionic, zwitterionic, ampholytic and cationic surfactants, and mixtures thereof. The surfactant preferably represents from about 10% to about 30%, and more preferably from about 14% to about 20%, by weight of the detergent composition. Surfactants useful herein are listed in U.S. Pat. No. 3,644,961, Norris, issued May 23, 1972, and in U.S. Pat. No. 3,919,678, Laughlin, et al., issued Dec. 30, 1975, both incorporated herein by reference. Useful cationic surfactants also include those described in U.S. Pat. No. 4,222,905, Cockrell, issued Sept. 16, 1980, and in U.S. Pat. No. 4,239,659, Murphy, issued Dec. 16, 1980, both incorporated herein by reference. However, cationic surfactants are generally less compatible with the aluminosilicate materials herein, and thus are preferably used at low levels, if at all, in the present compositions. The following are representative examples of surfactants useful in the present compositions.

Water-soluble salts of the higher fatty acids, i.e., "soaps", are useful anionic surfactants in the compositions herein. This includes alkali metal soaps such as the sodium, potassium, ammonium, and alkylolammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Useful anionic surfactants also include the water-soluble salts, preferably the alkali metal, ammonium and alkylolammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.) Examples of this group of synthetic surfactants are the sodium and potassium alkyl sulfates, especially those obtained by sulfating the higher alcohols ($C_8$–$C_{18}$ carbon atoms) such as those produced by reducing the glycerides of tallow or coconut oil; and the sodium and potassium alkyl benzene sulfonates in which the alkyl group contains from about 9 to about 15 carbon atoms, in straight chain or branched chain configuration, e.g., those of the type described in U.S. Pat. Nos. 2,220,099 and 2,477,383. Especially valuable are linear straight chain alkyl benzene sulfonates in which the average number of carbon atoms in the alkyl group is from about 11 to 13, abbreviated as $C_{11-13}$LAS.

Other anionic surfactants herein are the sodium alkyl glyceryl ether sulfonates, especially those ethers of higher alcohols derived from tallow and coconut oil; sodium coconut oil fatty acid monoglyceride sulfonates and sulfates; sodium or potassium salts of alkyl phenol ethylene oxide ether sulfates containing from about 1 to about 10 units of ethylene oxide per molecule and wherein the alkyl groups contain from about 8 to about 12 carbon atoms; and sodium or potassium salts of alkyl ethylene oxide ether sulfates containing about 1 to about 10 units of ethylene oxide per molecule and wherein the alkyl group contains from about 10 to about 20 carbon atoms.

Other useful anionic surfactants herein include the water-soluble salts of esters of alpha-sulfonated fatty acids containing from about 6 to 20 carbon atoms in the fatty acid group and from about 1 to 10 carbon atoms in the ester group; water-soluble salts of 2-acyloxy-alkane-1-sulfonic acids containing from about 2 to 9 carbon atoms in the acyl group and from about 9 to about 23 carbon atoms in the alkane moiety; alkyl ether sulfates containing from about 10 to 20 carbon atoms in the alkyl group and from about 1 to 30 moles of ethylene oxide; water-soluble salts of olefin sulfonates containing from about 12 to 24 carbon atoms; and beta-alkyloxy alkane sulfonates containing from about 1 to 3 carbon atoms in the alkyl group and from about 8 to 20 carbon atoms in the alkane moiety.

Water-soluble nonionic surfactants are also useful in the compositions of the invention. Such nonionic materials include compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having the desired degree of balance between hydrophilic and hydrophobic elements.

Suitable nonionic surfactants include the polyethylene oxide condensates of alkyl phenols, e.g., the condensation products of alkyl phenols having an alkyl group containing from about 6 to 15 carbon atoms, in either a straight chain or branched chain configuration, with from about 3 to 12 moles of ethylene oxide per mole of alkyl phenol.

Preferred nonionics are the water-soluble condensation products of aliphatic alcohols containing from 8 to 22 carbon atoms, in either straight chain or branched configuration, with from 3 to 12 moles of ethylene oxide per mole of alcohol. Particularly preferred are the condensation products of alcohols having an alkyl group containing from about 9 to 15 carbon atoms with from about 4 to 8 moles of ethylene oxide per mole of alcohol.

Semi-polar nonionic surfactants include water-soluble amine oxides containing one alkyl moiety of from about 10 to 18 carbon atoms and 2 moieties selected from the group consisting of alkyl groups and hydroxyalkyl groups containing from 1 to about 3 carbon atoms; water-soluble phosphine oxides containing one alkyl moiety of about 10 to 18 carbon atoms and 2 moieties selected from the group consisting of alkyl groups and hydroxyalkyl groups containing from about 1 to 3 carbon atoms; and water-soluble sulfoxides containing one alkyl moiety of from about 10 to 18 carbon atoms and a moiety selected from the group consisting of alkyl and hydroxyalkyl moieties of from about 1 to 3 carbon atoms.

Ampholytic surfactants include derivatives of aliphatic or aliphatic derivatives of heterocyclic secondary and tertiary amines in which the aliphatic moiety can be straight chain or branched and wherein one of the aliphatic substituents contains from about 8 to 18 carbon atoms and at least one aliphatic substituent contains an anionic water-solubilizing group.

Zwitterionic surfactants include derivatives of aliphatic quaternary ammonium, phosphonium, and sulfonium compounds in which one of the aliphatic substituents contains from about 8 to 18 carbon atoms.

Particularly preferred surfactants herein include linear alkylbenzene sulfonates containing from about 11 to 14 carbon atoms in the alkyl group; tallowalkyl sulfates; coconutalkyl glyceryl ether sulfonates; alkyl ether sulfates wherein the alkyl moiety contains from about 14 to 18 carbon atoms and wherein the average degree of ethoxylation is from about 1 to 4; olefin or paraffin sulfonates containing from about 14 to 16 carbon atoms; alkyldimethyl amine oxides wherein the alkyl group contains from about 11 to 16 carbon atoms; alkyldimethylammonio propane sulfonates and alkyldimethylammonio hydroxy propane sulfonates wherein the alkyl group contains from about 14 to 18 carbon atoms; soaps of higher fatty acids containing from about 12 to 18 carbon atoms; condensation products of $C_9$–$C_{15}$ alcohols with from about 4 to 8 moles of ethylene oxide, and mixtures thereof.

Specific preferred surfactants for use herein include: sodium linear $C_{11-13}$ alkylbenzene sulfonate; triethanolamine $C_{11-13}$ alkylbenzene sulfonate; sodium tallow alkyl sulfate; sodium coconut alkyl glyceryl ether sulfonate; the sodium salt of a sulfated condensation product of a tallow alcohol with about 4 moles of ethylene oxide; the condensation product of a coconut fatty alcohol with about 6 moles of ethylene oxide; the condensation product of tallow fatty alcohol with about 11 moles of ethylene oxide; 3-(N,N-dimethyl-N-coconutalkylammonio)-2-hydroxypropane-1-sulfonate; 3-(N,N-dimethyl-N-coconutalkylammonio)-propane-1-sulfonate; 6-(N-dodecylbenzyl-N,N-dimethylammonio) hexanoate; dodecyl dimethyl amine oxide; coconut alkyldimethyl amine oxide; and the water-soluble sodium and potassium salts of coconut and tallow fatty acids.

ALUMINOSILICATE ION EXCHANGE MATERIAL

The detergent compositions herein also contain from about 10% to about 60%, preferably from about 15% to about 40%, and more preferably from about 18% to about 30%, by weight of crystalline aluminosilicate ion exchange material of the formula $$Na_z[(AlO_2)_z.(SiO_2)_y].xH_2O$$

wherein z and y are at least about 6, the molar ration of z to y is from about 1.0 to about 0.5 and x is from about 10 to about 264. Amorphous hydrated aluminosilicate materials useful herein have the empirical formula $$M_z(zAlO_2.ySiO_2)$$

wherein M is sodium, potassium, ammonium or substituted ammonium, z is from about 0.5 to about 2 and y is 1, said material having a magnesium ion exchange capacity of at least about 50 milligram equivalents of $CaCO_3$ hardness per gram of anhydrous aluminosilicate.

The aluminosilicate ion exchange builder materials herein are in hydrated form and contain from about 10% to about 28% of water by weight if crystalline, and potentially even higher amounts of water if amorphous. Highly preferred crystalline aluminosilicate ion exchange materials contain from about 18% to about 22% water in their crystal matrix. The crystalline aluminosilicate ion exchange materials are further characterized by a particle size diameter of from about 0.1 micron to about 10 microns. Amorphous materials are often smaller, e.g., down to less than about 0.01 micron. Preferred ion exchange materials have a particle size diameter of from about 0.2 micron to about 4 microns. The term "particle size diameter" herein represents the average particle size diameter of a given ion exchange material as determined by conventional analytical techniques such as, for example, microscopic determination utilizing a scanning electron microscope. The crystalline aluminosilicate ion exchange materials herein are usually further characterized by their calcium ion exchange capacity, which is at least about 200 mg. equivalent of $CaCO_3$ water hardness/g. of aluminosilicate, calculated on an anhydrous basis, and which generally is in the range of from about 300 mg. eq./g. to about 352 mg. eq./g. The aluminosilicate ion exchange materials herein are still further characterized by their calcium ion exchange rate which is at least about 2 grains $Ca^{++}$/gallon/minute/gram/gallon of aluminosilicate (anhydrous basis), and generally lies within the range of from about 2 grains/gallon/minute/gram/gallon to about 6 grains/gallon/minute/gram/gallon, based on calcium ion hardness. Optimum aluminosilicate for builder purposes exhibit a calcium ion exchange rate of at least about 4 grains/gallon/minute/gram/gallon.

The amorphous aluminosilicate ion exchange materials usually have a $Mg^{++}$ exchange capacity of at least about 50 mg. eq. $CaCO_3$/g. (12 mg. $Mg^{++}$/g.) and a $Mg^{++}$ exchange rate of at least about 1 grain/gallon/minute/gram/gallon. Amorphous materials do not exhibit an observable diffraction pattern when examined by Cu radiation (1.54 Angstrom Units).

Aluminosilicate ion exchange materials useful in the practice of this invention are commercially available. The aluminosilicates useful in this invention can be crystalline or amorphous in structure and can be naturally-occurring aluminosilicates or synthetically derived. A method for producing aluminosilicate ion exchange materials is discussed in U.S. Pat. No. 3,985,669, Krummel, et al., issued Oct. 12, 1976, incorporated herein by reference. Preferred synthetic crystalline aluminosilicate ion exchange materials useful herein are available under the designations Zeolite A, Zeolite B, and Zeolite X. In an especially preferred embodiment, the crystalline aluminosilicate ion exchange material has the formula $$Na_{12}[AlO_2)_{12}(SiO_2)_{12}].xH_2O$$

wherein x is from about 20 to about 30, especially about 27.

WATER-SOLUBLE NEUTRAL OR ALKALINE SALT

The granular detergents of the present invention additionally contain from about 5% to about 75%, preferably from about 10% to about 60%, and more preferably from about 20% to about 50%, by weight of a water-soluble neutral or alkaline salt. The neutral or alkaline salt has a pH in solution of seven or greater, and can be either organic or inorganic in nature. The salt assists in providing the desired density and bulk to the detergent granules herein. While some of the salts are inert, many of them also function as detergency builder materials in the laundering solution.

Examples of neutral water-soluble salts include the alkali metal, ammonium or substituted ammonium chlorides, fluorides and sulfates. The alkali metal, and especially sodium, salts of the above are preferred. Sodium sulfate is typically used in detergent granules and is a particularly preferred salt herein.

Other useful water-soluble salts include the compounds commonly known as detergent builder materials. Builders are generally selected from the various water-soluble, alkali metal, ammonium or substituted ammonium phosphates, polyphosphates, phosphonates, polyphosphonates, carbonates, silicates, borates, polyhydroxysulfonates, polyacetates, carboxylates, and polycarboxylates. Preferred are the alkali metal, especially sodium, salts of the above. However, as previously described, the present compositions contain less than about 3%, preferably less than about 2%, by weight of silicate materials and less than about 10%, preferably less than about 5%, by weight of phosphate materials. Most preferably, the compositions are substantially free of phosphates.

Specific examples of inorganic phosphate builders are sodium and potassium tripolyphosphate, pyrophosphate, polymeric metaphosphate having a degree of polymerization of from about 6 to 21, and orthophosphate. Examples of polyphosphonate builders are the sodium and potassium salts of ethylene diphosphonic acid, the sodium and potassium salts of ethane 1-hydroxy-1,1-diphosphonic acid and the sodium and potassium salts of ethane, 1,1,2-triphosphonic acid. Other phosphorus builder compounds are disclosed in U.S. Pat. Nos. 3,159,581; 3,213,030; 3,422,021; 3,422,137; 3,400,176 and 3,400,148, incorporated herein by reference.

Examples of non-phosphorus, inorganic builders are sodium and potassium carbonate, bicarbonate, sesquicarbonate, tetraborate decahydrate, and silicate having a molar ratio of $SiO_2$ to alkali metal oxide of from about 0.5 to about 4.0, preferably from about 1.0 to about 2.4.

Water-soluble, non-phosphorus organic builders useful herein include the various alkali metal, ammonium and substituted ammonium polyacetates, carboxylates, polycarboxylates and polyhydroxysulfonates. Examples of polyacetate and polycarboxylate builders are the sodium, potassium, lithium, ammonium and substituted ammonium salts of ethylene diamine tetraacetic acid, nitrilotriacetic acid, oxydisuccinic acid, mellitic acid, benzene polycarboxylic acids, and citric acid.

Highly preferred polycarboxylate builders herein are set forth in U.S. Pat. No. 3,308,067, Diehl, issued Mar. 7, 1967 incorporated herein by reference. Such materials include the water-soluble salts of homo- and copolymers of aliphatic carboxylic acids such as maleic acid, itaconic acid, mesaconic acid, fumaric acid, aconitic acid, citraconic acid and methylenemalonic acid.

Other useful builders herein are sodium and potassium carboxymethyloxymalonate, carboxymethyloxysuccinate, cis-cyclohexanehexacarboxylate, cis-cyclopentanetetracarboxylate phloroglucinol trisulfonate, and the copolymers of maleic anhydride with vinyl methyl ether or ethylene.

Other suitable polycarboxylates for use herein are the polyacetal carboxylates described in U.S. Pat. No. 4,144,226, issued Mar. 13, 1979 to Crutchfiled, et al., and U.S. Pat. No. 4,246,495, issued Mar. 27, 1979 to Crutchfield, et al., both incorporated herein by reference. These polyacetal carboxylates can be prepared by bringing together under polymerization conditions an ester of glyoxylic acid and a polymerization initiator. The resulting polyacetal carboxylate ester is then attached to chemically stable end groups to stabilize the polyacetal carboxylate against rapid depolymerization in alkaline solution, converted to the corresponding salt, and added to a surfactant.

Other detergency builder materials useful herein are the "seeded builder" compositions disclosed in Belgian Pat. No. 798,856, issued Oct. 29, 1973, incorporated herein by reference. Specific examples of such seeded builder mixtures are: 3:1 wt. mixtures of sodium carbonate and calcium carbonate having 5 micron particle diameter; 2.7:1 wt. mixtures of sodium sesquicarbonate and calcium carbonate having a particle diameter of 0.5 microns; 20:1 wt. mixtures of sodium sesquicarbonate and calcium hydroxide having a particle diameter of 0.01 micron; and a 3:3:1 wt. mixture of sodium carbonate, sodium aluminate and calcium oxide having a particle diameter of 5 microns.

FILM-FORMING POLYMER

The compositions of the present invention also contain from about 0.1% to about 10%, preferably from about 0.5% to about 7%, and more preferably from about 1% to about 4%, by weight of a film-forming polymer soluble in an aqueous slurry comprising the organic surfactants, aluminosilicate materials, and neutral or alkaline salts herein. It will be appreciated that the polymer must be at least partially soluble in the slurry for it to dry to a film capable of cementing the granule walls together as the slurry is dried. For optimum granule physical properties, the polymer should be substantially soluble in the slurry, and is preferably completely soluble in the slurry. The slurry will typically comprise a surfactant phase and the insoluble aluminosilicate material suspended in a solution (often saturated) of the neutral or alkaline salt, which preferably comprises sodium sulfate. The slurry will usually be alkaline in nature due to the presence of the aluminosilicate material and either anionic surfactants or alkaline salts. Since the slurry will generally be a strong electrolyte solution, optimum solubility of the polymer is obtained when it is in the form of an at least partially neutralized or substituted alkali metal, ammonium or substituted ammonium (e.g., mono-, di- or triethanol ammonium) salt. The alkali metal, especially sodium, salts are most preferred. While the molecular weight of the polymer can vary over a wide range, it preferably is from about 1000 to about 500,000, more preferably is from about 2000 to about 250,000, and most preferably is from about 3000 to about 100,000.

Suitable film-forming polymers herein include homopolymers and copolymers of unsaturated aliphatic mono- or polycarboxylic acids. Preferred carboxylic acids are acrylic acid, hydroxyacrylic acid, methacrylic acid, maleic acid, fumaric acid, itaconic acid, aconitic acid, crotonic acid, and citraconic acid. The polycarboxylic acids (e.g. maleic acid) can be polymerised in the form of their anhydrides and subsequently hydrolyzed. The copolymers can be formed of mixtures of the unsaturated carboxylic acids with or without other copolymerisable monomers, or they can be formed from single unsaturated carboxylic acids with other copolymerisable monomers. In either case, the percentage by weight of the polymer units derived from non-carboxylic acids is preferably less than about 50%. Suitable copolymerisable monomers include, for example, vinyl chloride, vinyl alcohol, furan, acrylonitrile, vinyl acetate, methyl acrylate, methyl methacrylate, styrene, vinyl methyl ether, vinyl ethyl ether, vinyl propyl ether, acrylamide, ethylene, propylene and 3-butenoic acid.

Preferred polymers of the above group are the homopolymers and copolymers of acrylic acid, hydroxyacrylic acid, or methacrylic acid, which in the case of the copolymers contain at least about 50%, and preferably at least about 80%, by weight of units derived from the acid. Particularly preferred polymers are sodium polyacrylate and sodium polyhydroxyacrylate. Other specific preferred polymers are the homopolymers and copolymers of maleic anhydride, especially the copolymers with ethylene, styrene and vinyl methyl ether. These polymers are commercially available under the trade names Veriscol and Gantrez.

The polymerisation of acrylic acid homo- and copolymers can be accomplished using free-radical initiators, such as alkali metal persulphates, acyl and aryl peroxides, acyl and aryl peresters and aliphatic azocompounds. The reaction can be carried out in situ or in aqueous or non-aqueous solutions or suspensions. Chain-terminating agents can be added to control the molecular weight. The copolymers of maleic anhydride can be synthesised using any of the types of free-radical initiators mentioned above in suitable solvents such as benzene or acetone, or in the absence of a solvent, under an inert atmosphere. These polymerisation techniques are well known in the art. It will be appreciated that instead of using a single polymeric aliphatic carboxylic acid, mixtures of two or more polymeric aliphatic carboxylic acids can be used to prepare the above polymers.

Other film-forming polymers useful herein include the cellulose sulfate esters such as cellulose acetate sulfate, cellulose sulfate, hydroxyethyl cellulose sulfate, methylcellulose sulfate, and hydroxypropylcellulose sulfate. Sodium cellulose sulfate is the most preferred polymer of this group.

Other suitable film-forming polymers are the carboxylated polysaccharides, particularly starches, celluloses and alginates, described in U.S. Pat. No. 3,723,322, Diehl, issued Mar. 27, 1973; the dextrin esters of polycarboxylic acids disclosed in U.S. Pat. No. 3,919,107, Thompson, issued Nov. 11, 1975; the hydroxyalkyl starch ethers, starch esters, oxidized starches, dextrins and starch hydrolysates described in U.S. Pat. No. 3,803,285, Jensen, issued Apr. 9, 1974; and the carboxylated starches described in U.S. Pat. No. 3,629,121, Eldib, issued Dec. 21, 1971; all incorporated herein by reference. Preferred polymers of the above group are the carboxymethyl celluloses.

Particularly preferred polymers for use herein are copolymers of acrylamide and acrylate having a molecular weight of from about 3,000 to about 100,000, preferably from about 4,000 to about 20,000, and an acrylamide content of less than about 50%, preferably less than about 20%, of the polymer. Most preferably, the polymer has a molecular weight of from about 4,000 to about 10,000 and an acrylamide content of from about 5% to about 15%. Such a polymer acts to increase the percentage of a crutcher mix that is in the aqueous (lye) phase. This improves the rate at which droplets of the crutcher mix will dry in a spray tower and can desirably increase the density of the resulting detergent granules when, for example, large amounts of sodium sulfate or other high-density inorganic salt is in the lye phase.

It has also been found, surprisingly, that a mixture of the preferred polyacrylamide copolymer and from about 0.5% to about 2%, preferably from about 0.5% to about 1%, by weight of a low-ratio silicate, i.e., one having a ratio of from about 1.0 to about 1.4, provides optimum granule structure and solubility. In an especially preferred aspect, the crutcher mix contains additional alkalinity, e.g., by way of added sodium carbonate at a level of from about 1% to about 30% or its alkalinity equivalent, as a water-soluble inorganic material and contains less than about 50% sodium sulfate, by weight of the finished product, preferably less than about 30%, to achieve normal densities without additional additives.

Other ingredients commonly used in detergent compositions can be included in the compositions of the present invention. These include color speckles, bleaching agents and bleach activators, suds boosters or suds suppressors, anti-tarnish and anti-corrosion agents, soil suspending agents, soil release agents, dyes, fillers, optical brighteners, germicides, pH adjusting agents, non-builder alkalinity sources, hydrotropes, enzymes, enzyme-stabilizing agents, and perfumes.

The following non-limiting examples illustrate the detergent compositions of the present invention.

All percentages, parts, and ratios used herein are by weight unless otherwise specified.

The following granular detergent compositions were evaluated using the indicated tests.

COMPRESSION TEST

The granules are poured into a standard cylinder and compressed by applying a 20 pound weight for about 60 seconds. The difference in height in inches is the compression grade. Lower numbers are therefore better. Grades of less than about 30 are acceptable.

CAKE TEST

The compressed, unsupported cylinder of granules created by the compression test is fractured by applying a weight to the top until the cylinder fractures. The weight in pounds required to fracture the cylinder is the cake grade. For products prepared in a small 10′ diameter tower, grades of less than about 20 are acceptable.

BLACK FABRIC TEST

The detergent composition is dissolved in water under standard conditions and filtered with suction through a black knit fabric and graded against photographic standards. Grades of 8 to 10 are acceptable.

EXAMPLE I

| Component | Parts |
|---|---|
| Sodium $C_{12}$ alkyl benzene sulfonate | 7.0 |
| Sodium $C_{14-15}$ alkyl polyethoxy$_{2.2}$ sulfate | 5.5 |
| Sodium tallow alkylsulfate | 5.5 |
| Hydrated sodium Zeolite A (avg. diameter of 3 microns) | 24.4 |
| Sodium silicate (1.6r) | 8.5 |
| Sodium sulfate | 24.6 |
| Water | 7.6 |
| Sodium carbonate (admixed) | 14.6 |

The above composition had a black fabric grade of 4. Grades of 10 were obtained when the 8.5 parts of sodium silicate was replaced with: 8.5 parts of sodium sulfate; 1.5 parts of sodium carboxymethyl cellulose and 7 parts of sodium sulfate; 3 parts of sodium carboxymethyl cellulose and 5.5 parts of sodium sulfate; 0.8 parts of sodium cellulose sulfate and 7.7 parts of sodium sulfate; and 3 parts of sodium cellulose sulfate and 5.5 parts of sodium sulfate.

EXAMPLES

| Component | II | III | IV | V | VI | VII | VIII | IX | X | XI |
|---|---|---|---|---|---|---|---|---|---|---|
| Sodium $C_{12}$ alkyl benzene sulfonate | | | | | | 6.2 | | | | |
| Sodium $C_{14-15}$ alkyl polyethoxy$_{2.2}$ sulfate | | | | | | 4.9 | | | | |
| Sodium tallow alkylsulfate | | | | | | 4.9 | | | | |
| Hydrated sodium Zeolite A (avg. diameter of 3 microns) | 20 | 20 | 20 | 20 | 20 | 25 | 20 | 25 | 25 | 25 |
| Sodium silicate (1.6r) | 0 | 2 | 0 | 0 | 0 | 0 | 2 | 0 | 0 | 0 |
| Sodium silicate (1.0r) | 0 | 0 | 2 | 4 | 2 | 1 | 0 | 2 | 2 | 2 |
| Sodium carbonate (crutched) | 0 | 0 | 0 | 0 | 0 | 0 | 0 | 20 | 20 | 5 |
| Sodium carbonate (admixed) | 13 | 13 | 13 | 13 | 13 | 13 | 13 | 0 | 0 | 15 |
| Polyacrylamide/acrylate sodium (M.Wt. of 4000–10,000; 5–15% amide) | 2 | 2 | 2 | 2 | 2 | 2 | 0 | 2 | 1 | 2 |
| Water | | | | | | 5–6% | | | | |
| Micellaneous minors and sodium sulfate | | | | | | balance | | | | |
| Cake grade | 6–8 | 1–3 | 6–14 | 2–6 | 12–20 | 1–11 | 9–19 | 5–10 | 5–10 | 8–12 |
| Compression grade | 15–17 | 9–12 | 12–14 | 8–12 | 16–18 | 10–15 | 14–26 | 8–14 | 8–14 | 11–14 |
| Black fabric grade (initial) | 10 | 7* | 9 | 9 | 10 | 9 | 9 | 10 | 10 | 10 |
| Black fabric grade (aged) | 10 | 6* | 8.5 | 7* | 9 | 8.5 | 9 | 10 | 10 | 10 |

*(fine powder)

Under stress storage conditions, e.g., high humidity and temperature, the composition of Example II exhibits marginal cake and compression grades.

What is claimed is:

1. A granular detergent composition comprising:

(a) from about 5% to about 40% by weight of an organic surfactant selected from the group consisting of anionic, nonionic, zwitterionic, ampholytic and cationic surfactants, and mixtures thereof;

(b) from about 10% to about 60% by weight of a finely divided aluminosilicate ion exchange material selected from the group consisting of:

(1) crystalline aluminosilicate material of the formula:

$$Na_z[(AlO_2)_z.(SiO_2)_y].xH_2O$$

wherein z and y are at least 6, the molar ratio of z to y is from 1.0 to 0.5 and x is from 10 to 264, said material having a particle size diameter of from about 0.1 micron to about 10 microns, a calcium ion exchange capacity of at least about 200 mg. $CaCO_3$ eq./g. and a calcium ion exchange rate of at least about 2 grains $Ca^{++}$/gallon/minute/gram/gallon;

(2) amorphous hydrated aluminosilicate material of the empirical formula:

$$M_z(zAlO_2.ySiO_2)$$

wherein M is sodium, potassium, ammonium, or substituted ammonium, z is from about 0.5 to about 2 and y is 1, said material having a magnesium ion exchange capacity of at least about 50 milligram equivalents of $CaCO_3$ hardness per gram of anhydrous aluminosilicate and a $Mg^{++}$ exchange rate of at least about 1 grain/gallon/minute/gram/gallon; and (3) mixtures thereof; and (c) from about 5% to about 75% by weight of a water-soluble neutral or alkaline salt; and (d) from about 0.1% to about 10% by weight of a film-forming polymer soluble in an aqueous slurry comprising the above components, said film-forming polymer being an at least partially neutralized salt of: a homopolymer or copolymer of acrylic acid, hydroxyacrylic acid, or methacrylic acid, cellulose acetate sulfate; cellulose sulfate; hydroxyethylcellulose sulfate; methylcellulose sulfate; or hydroxypropylcellulose sulfate; said composition containing less than about 10% by weight of phosphate materials and less than about 3% by weight of alkali metal silicate materials.

2. A composition according to claim 1 comprising from about 10% to about 30% by weight of the organic surfactant.

3. A composition according to claim 2 comprising from about 14% to about 20% by weight of the organic surfactant.

4. A composition according to claim 1 wherein the organic surfactant is selected from the group consisting of linear alkylbenzene sulfonates containing from about 11 to 14 carbon atoms in the alkyl group, tallowalkyl sulfates; coconutalkyl glyceryl ether sulfonates; alkyl ether sulfates wherein the alkyl moiety contains from about 14 to 18 carbon atoms and wherein the average degree of ethoxylation is from about 1 to 4; olefin or paraffin sulfonates containing from about 14 to 16 carbon atoms; alkyldimethyl amine oxides wherein the alkyl group contains from about 11 to 16 carbon atoms; alkyldimethylammonio propane sulfonates and alkyldimethylammonio hydroxy propane sulfonates wherein the alkyl group contains from about 14 to 18 carbon atoms; soaps of higher fatty acids containing from about 12 to 18 carbon atoms; condensation products of $C_9$–$C_{15}$ alcohols with from about 4 to 8 moles of ethylene oxide, and mixtures thereof.

5. A composition according to claim 1 comprising from about 15% to about 40% by weight of the aluminosilicate ion exchange material.

6. A composition according to claim 5 comprising from about 18% to about 30% by weight of the aluminosilicate ion exchange material.

7. A composition according to claim 1 wherein the aluminosilicate ion exchange material is of the formula $$Na_{12}[(AlO_2)_{12}(SiO_2)_{12}].xH_2O,$$

wherein x is from about 20 to about 30.

8. A composition according to claim 7 wherein the organic surfactant is selected from the group consisting of linear alkylbenzene sulfonates containing from about 11 to 14 carbon atoms in the alkyl group, tallowalkyl sulfates; coconutalkyl glyceryl ether sulfonates; alkyl ether sulfates wherein the alkyl moiety contains from about 14 to 18 carbon atoms and wherein the average degree of ethoxylation is from about 1 to 4; olefin or paraffin sulfonates containing from about 14 to 16 carbon atoms; alkyldimethyl amine oxides wherein the alkyl group contains from about 11 to 16 carbon atoms; alkyldimethylammonio propane sulfonates and alkyldimethylammonio hydroxy propane sulfonates wherein the alkyl group contains from about 14 to 18 carbon atoms; soaps of higher fatty acids containing from about 12 to 18 carbon atoms; condensation products of $C_9$–$C_{15}$ alcohols with from about 4 to 8 moles of ethylene oxide, and mixtures thereof.

9. A composition according to claim 1 comprising from about 10% to about 60% by weight of the water-soluble neutral or alkaline salt.

10. A composition according to claim 1 wherein the water-soluble neutral or alkaline salt comprises sodium sulfate.

11. A composition according to claim 1 comprising from about 0.5% to about 7% by weight of the film-forming polymer.

12. A composition according to claim 11 comprising from about 1% to about 4% by weight of the film-forming polymer.

13. A composition according to claim 1 wherein the film-forming polymer has a molecular weight of from about 1000 to about 500,000.

14. A composition according to claim 13 wherein the film-forming polymer has a molecular weight of from about 2000 to about 250,000.

15. A composition according to claim 14 wherein the film-forming polymer has a molecular weight of from about 3000 to about 100,000.

16. A composition according to claim 15 wherein the film-forming polymer is an at least partially neutralized salt of a homopolymer or copolymer of acrylic acid, hydroxyacrylic acid or methacrylic acid.

17. A composition according to claim 16 wherein the film-forming polymer is a copolymer of acrylamide and sodium acrylate having a molecular weight of from about 3000 to about 100,000 and an acrylamide content of less than about 50%.

18. A composition according to claim 17 wherein the copolymer has a molecular weight of from about 4000 to about 10,000 and an acrylamide content of from about 5% to about 15%.

19. A composition according to claim 16 wherein the film-forming polymer is sodium polyacrylate or sodium polyhydroxyacrylate.

20. A composition according to claim 1 wherein the film-forming polymer is selected from the group consisting of salts of cellulose acetate sulfate, cellulose sulfate, hydroxyethyl cellulose sulfate, methylcellulose sulfate, and hydroxypropylcellulose sulfate.

21. A composition according to claim 20 wherein the film-forming polymer is sodium cellulose sulfate.

22. A composition according to claim 1 containing less than about 5% by weight of phosphate materials.

23. A composition according to claim 22 which is substantially free of phosphate materials.

24. A composition according to claim 23 containing less than about 2% by weight of alkali metal silicate materials.

25. A composition according to claim 24 wherein the aluminosilicate ion exchange material is of the formula $$Na_{12}[(AlO_2)_{12}(SiO_2)_{12}].xH_2O$$

wherein x is from about 20 to about 30.

26. A composition according to claim 25 wherein the organic surfactant is selected from the group consisting of linear alkylbenzene sulfonates containing from about 11 to 14 carbon atoms in the alkyl group, tallowalkyl sulfates; coconutalkyl glyceryl ether sulfonates; alkyl ether sulfates wherein the alkyl moiety contains from about 14 to 18 carbon atoms and wherein the average degree of ethoxylation is from about 1 to 4; olefin or paraffin sulfonates containing from about 14 to 16 carbon atoms; alkyldimethyl amine oxides wherein the alkyl group contains from about 11 to 16 carbon atoms; alkyldimethylammonio propane sulfonates and alkyldimethylammonio hydroxy propane sulfonates wherein the alkyl group contains from about 14 to 18 carbon atoms; soaps of higher fatty acids containing from about 12 to 18 carbon atoms; condensation products of $C_9$–$C_{15}$ alcohols with from about 4 to 8 moles of ethylene oxide, and mixtures thereof.

27. A composition according to claim 26 wherein the water-soluble neutral or alkaline salt comprises sodium sulfate.

28. A composition according to claim 27 wherein the film-forming polymer is a copolymer of acrylamide and sodium acrylate having a molecular weight of from about 4000 to about 10,000 and an acrylamide content of from about 5% to about 15%.

29. A composition according to claim 27 wherein the film-forming polymer is an at least partially neutralized salt of a homopolymer or copolymer of acrylic acid, hydroxyacrylic acid or methacrylic acid.

30. A composition according to claim 29 wherein the film-forming polymer is sodium polyacrylate or sodium polyhydroxyacrylate.

31. A composition according to claim 30 wherein the film-forming polymer has a molecular weight of from about 3000 to about 100,000 and represents from about 1% to about 4% by weight of the composition.

* * * * *